US009937730B2

(12) United States Patent
Kubo et al.

(10) Patent No.: US 9,937,730 B2
(45) Date of Patent: Apr. 10, 2018

(54) PRINTER

(71) Applicant: SATO HOLDINGS KABUSHIKI KAISHA, Tokyo (JP)

(72) Inventors: Yoshimasa Kubo, Saitama (JP); Seiichiro Nagata, Saitama (JP); Yasushi Sato, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/511,097

(22) PCT Filed: Aug. 21, 2015

(86) PCT No.: PCT/JP2015/073484
§ 371 (c)(1),
(2) Date: Mar. 14, 2017

(87) PCT Pub. No.: WO2017/033221
PCT Pub. Date: Mar. 2, 2017

(65) Prior Publication Data

US 2017/0282592 A1 Oct. 5, 2017

(51) Int. Cl.
*B41J 2/355* (2006.01)
*B41J 2/045* (2006.01)

(52) U.S. Cl.
CPC ..... *B41J 2/355* (2013.01); *B41J 2/0458* (2013.01); *B41J 2/04536* (2013.01); *B41J 2/04541* (2013.01); *B41J 2/04573* (2013.01)

(58) Field of Classification Search
CPC .... B41J 2/355; B41J 2/04536; B41J 2/04541; B41J 2/04573; B41J 2/04548; G06K 15/105; G06K 15/107
(Continued)

(56) References Cited

U.S. PATENT DOCUMENTS 5,173,717 A * 12/1992 Kishida ..... B41J 2/04541 347/13
5,828,386 A * 10/1998 Okada ..... B41J 2/0451 347/9
(Continued)

FOREIGN PATENT DOCUMENTS

JP 2-194974 A 8/1990
JP 4-358851 A 12/1992
(Continued)

*Primary Examiner* — Huan Tran
*Assistant Examiner* — Alexander D Shenderov
(74) *Attorney, Agent, or Firm* — Foley & Lardner LLP

(57) ABSTRACT

A printer printing an image on a print medium based on print data including print dot data for each of print lines. The printer includes a print head including heating elements arranged along a direction of the print lines, and a controller finding the number of print dots on each print line and determining a first or second control mode as a control mode of the heating elements for printing each print line based on the found number of print dots. In the first control mode, the heating elements are divided into first groups including two or more adjacent heating elements and are heated at a different timing. In the second control mode, the heating elements are divided into second groups including two or more heating elements with at least two thereof spaced apart and are heated at a different timing.

18 Claims, 15 Drawing Sheets

(58) Field of Classification Search
USPC ..... 347/211
See application file for complete search history.

(56) References Cited

U.S. PATENT DOCUMENTS

| | | | | |
|---|---|---|---|---|
| 5,907,331 | A * | 5/1999 | Markham | G06K 15/102 347/12 |
| 6,102,510 | A * | 8/2000 | Kikuta | B41J 2/04541 347/12 |
| 2001/0045967 | A1* | 11/2001 | Hayasaki | B41J 2/04541 347/9 |
| 2002/0113857 | A1* | 8/2002 | Jimbo | B41J 2/3551 347/182 |
| 2006/0125863 | A1* | 6/2006 | Silverbrook | B41J 2/04505 347/14 |
| 2010/0091051 | A1* | 4/2010 | Rueby | B41J 2/2132 347/8 |
| 2012/0026245 | A1* | 2/2012 | Kaneko | B41J 2/2139 347/40 |

FOREIGN PATENT DOCUMENTS

| | | | |
|---|---|---|---|
| JP | 5-220988 | A | 8/1993 |
| JP | 2002-137432 | A | 5/2002 |
| JP | 2009-148948 | A | 7/2009 |

* cited by examiner

FIG. 9

| CONTROL DATA | |
|---|---|
| PRINT LINE | CONTROL MODE |
| L(1) | 0 |
| ▪ | ▪ |
| L(19) | 0 |
| L(20) | 1 |
| L(21) | 2 |
| ▪ | ▪ |
| L(79) | 2 |
| L(80) | 1 |
| L(81) | 0 |
| ▪ | ▪ |
| L(100) | 0 |

FIG. 13

| CONTROL DATA | |
|---|---|
| PRINT LINE | CONTROL MODE |
| L(1) | 0 |
| ・ | ・ |
| L(19) | 0 |
| L(20) | 1 |
| L(21) | 2 |
| ・ | ・ |
| L(49) | 2 |
| L(50) | 3 |
| L(51) | 3 |
| ・ | ・ |
| L(79) | 3 |
| L(80) | 3 |
| L(81) | 0 |
| ・ | ・ |
| L(100) | 0 |

PRINTER

FIELD

The present invention relates to a printer that prints an image on a print medium based on print data.

BACKGROUND

A printer to print an image on a print medium having a thermosensitive layer includes a print head having a plurality of heating elements. The heating elements are arranged along a direction of a print line. Such a printer causes each heating element to generate heat independently by applying voltage separately to each heating element. When the print medium is heated by the heat-generating heating element, the thermosensitive layer of the print medium is colored for each print line. Thus, an image is printed on the print medium.

For printing a pictorial figure (e.g., a filled rectangle or ruled line) having many print dots on a single print line, it is required to cause many heating elements to generate heat at the same timing. Accordingly, power consumption of the printer becomes large. Recently, such power consumption is required to be suppressed. In particular, usable power is restricted with respect to remaining battery charge for a portable printer operating with a battery. Accordingly, power consumption is strongly required to be suppressed.

Conventionally, as a technology to suppress power consumption for printing a pictorial figure having many print dots on a single print line, there has been known a technology that a plurality of heating elements is divided into a plurality of groups and the heating elements generate heat at different timings for each groups (e.g., Japanese Patent Application Laid-open No. 2009-148948).

BRIEF SUMMARY

Technical Problem

According to the technology in Japanese Patent Application Laid-open No. 2009-148948, when some heating elements among the plurality of heating elements are caused to generate heat at a certain timing, temperature of heating elements without generating heat decreases with time. Consequently, temperature variation occurs among the heating elements. Owing to such temperature variation, variation also occurs in density of an image to be printed on a print medium. Accordingly, print quality of the image to be printed on the print medium deteriorates.

In short, according to the technology in Japanese Patent Application Laid-open No. 2009-148948, although power consumption of a printer can be suppressed, print quality of an image to be printed on a print medium decreases.

An object of the present invention is to suppress power consumption of a printer and prevent deterioration of print quality of an image to be printed on a print medium.

Solution to Problem

According to a first aspect of the present invention, it is provided a printer configured to print an image on a print medium based on print data that includes print dot data for each of a plurality of print lines, comprising:

a print head including a plurality of heating elements arranged along a direction of the print lines; and a controller configured to find the number of print dots on each print line and determine a first control mode or a second control mode as a control mode of the heating elements for printing each print line based on the found number of print dots, wherein in the first control mode dividing the heating elements into a plurality of first groups the controller controls the plurality of heating elements to generate heat at a different timing for each first group including two or more adjacent heating elements, and in the second control mode dividing the heating elements into a plurality of second groups the controller controls the plurality of heating elements to generate heat at a different timing for each second group including two or more heating elements, at least two of which are spaced apart.

The may determine based on the print data whether each print line is an edge line being a print line including an edge portion of the image or a non-edge line being a print line including a non-edge portion of the image, and determine the first control mode as a control mode for the edge line, and determine the second control mode as a control mode for the non-edge line.

The controller may calculate, among the print lines, a variation between the number of print dots of a target line being a print line for which the control mode is to be determined and the number of print dots of a reference line being a print line adjacent to the target line, and determine the target line as the edge line when the variation is equal to or larger than a predetermined first threshold value, and determine the target line as the non-edge line when the variation is smaller than the first threshold value.

A second aspect of the present invention, it is provided a printer configured to print an image on a print medium based on print data that includes print dot data for each of a plurality of print lines, comprising:

a print head including a plurality of heating elements arranged along a direction of the print lines; and a controller configured to find the number of print dots on each print line and determines any of first to third control modes as a control mode of the heating elements for printing each print line based on the found number of print dots, wherein in the first control mode dividing the heating elements into a plurality of first groups the controller controls the plurality of heating elements to generate heat at a different timing for each first group including two or more adjacent heating elements, and in the second control mode dividing the heating elements into a plurality of second groups the controller controls the plurality of heating elements to generate heat at a different timing for each second group including two or more heating elements, at least two of which are spaced apart, and in the third control mode, the controller controls the plurality of heating elements to generate heat at the same timing.

The controller may calculate, among the print lines, a variation between the number of print dots of a target line being a print line for which the control mode is to be determined and the number of print dots of a reference line being a print line adjacent to the target line, and determine the first control mode as a control mode for the target line when the variation is equal to or larger than a predetermined first threshold value and the number of print dots on the target line is equal to or larger than a predetermined second threshold value, determine the second control mode as a control mode for the target line when the variation is smaller than the first threshold value and the number of print dots on the target line is equal to or larger than the second threshold value, and determine the third control mode as a control mode for the target line when the number of print dots on the target line is smaller than the second threshold value.

The printer may further comprise a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

The controller may determine a first voltage as a voltage to be applied to the heating elements for printing a print line for which the first control mode is determined as the control mode, and determine a second voltage being higher than the first voltage as a voltage to be applied to the heating elements for printing a print line directly following the print line for which the first control mode is determined as the control mode.

Advantageous Effects

According to the present invention, it is possible to suppress power consumption of a printer and to prevent deterioration of print quality of an image to be printed on a print medium.

BRIEF DESCRIPTION OF DRAWINGS

FIG. 9 is a table showing an example of control data to be created in control data creation (S13 in FIG. 6) of the first embodiment.

FIG. 13 is a table showing an example of control data to be created in control data creation (S13 in FIG. 6) of the second embodiment.

DETAILED DESCRIPTION

In the following, embodiments of the present invention will be described with reference to the drawings.

1. First Embodiment

A first embodiment will be described.

1-1. Structure of Printer (FIGS. 1 and 2)

Description will be provided on a structure of a printer of the first embodiment. FIG. 1 is a schematic side view illustrating the structure of the printer of the first embodiment. FIG. 2 is a schematic view illustrating a plurality of heating elements of a print head 12 in FIG. 1.

Figure 1:
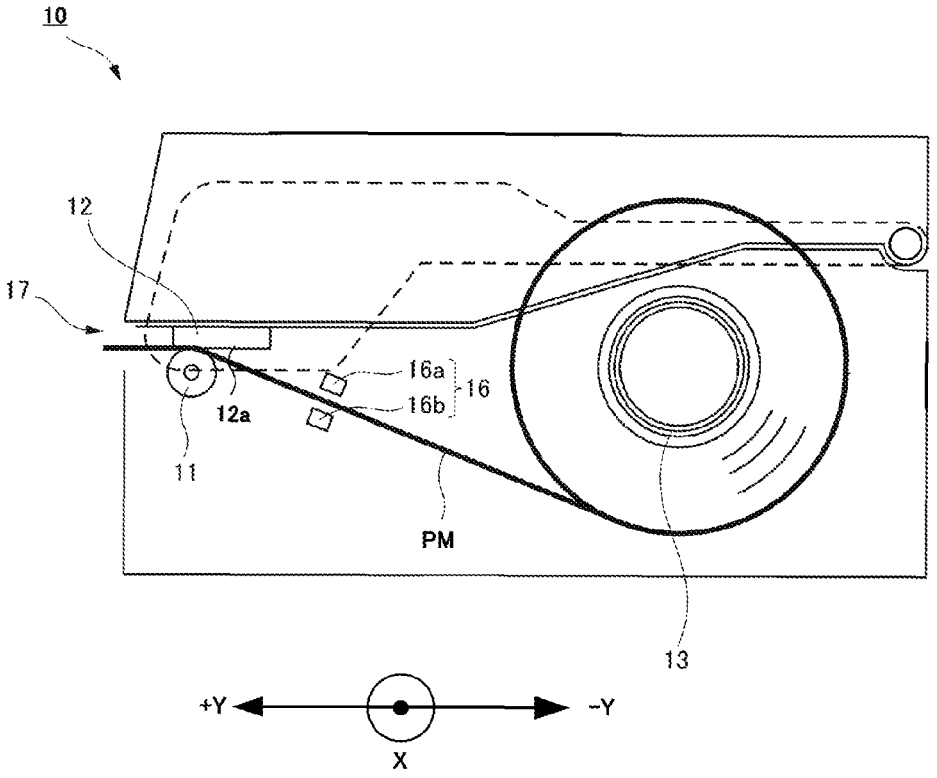
FIG. 1 is a schematic side view illustrating a structure of a printer of a first embodiment.
Figure 2:
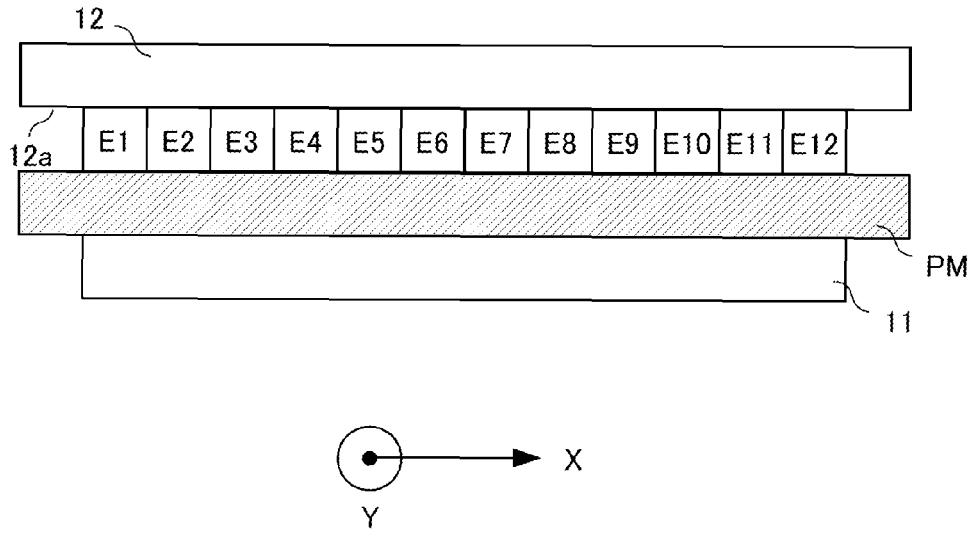
FIG. 2 is a schematic view illustrating a plurality of heating elements of a print head 12 in FIG. 1.

As illustrated in FIG. 1, a printer 10 of the present embodiment includes a platen roller 11, the print head 12, and a holder 13.

The holder 13 is configured to hold a roll-shaped print medium PM. The print medium PM is a label continuum having a thermosensitive layer and an adhesion layer. The thermosensitive layer is colored in response to heat.

The platen roller 11 is configured to feed the print medium PM in a predetermined feeding direction Y (+Y or −Y). The platen roller 11 is connected to a stepping motor (not illustrated) via a timing belt (not illustrated). When the stepping motor is driven, the platen roller 11 is rotated.

When the platen roller 11 is rotated in a forward direction, the roll-shaped print medium PM held by the holder 13 is extracted in a belt-like manner on feeding path from a side of the holder 13 (hereinafter, called an upstream side) toward a side of an ejection port 17 (hereinafter, called a downstream side) (i.e., toward direction +Y). The belt-shaped print medium PM extracted from the holder 13 is fed toward the ejection port 17 as being nipped by the platen roller 11 and the print head 12.

When the platen roller 11 is rotated in a reverse direction being opposite to the forward direction, the print medium PM is fed from the downstream side to the upstream side (i.e., toward direction −Y).

The print head 12 is configured to print an image on the print medium PM. The print head 12 has a print face 12*a*. The print face 12*a* is opposed to the platen roller 11 out of faces of the print head 12.

For easy understanding, in the present embodiment, description will be provided on an example that 12 pieces of heating elements E1 to E12 are arranged on the print face 12*a* of the print head 12 as illustrated in FIG. 2. The heating elements E1 to E12 are arranged along direction X of a print line perpendicular to direction Y (hereinafter, called a feeding direction) in which the print medium PM is fed.

When the thermosensitive layer of the print medium PM nipped by the platen roller 11 and the print head 12 is heated by the heating elements E1 to E12 of the print head 12, the heated thermosensitive layer is colored. Thus, an image is printed on the print medium PM.

Examples of the image include texts, figures, bar codes, and combinations thereof.

As illustrated in FIG. 1, an optical sensor 16 is disposed on the feeding path of the print medium PM from the holder 13 to the print head 12. The optical sensor 16 includes a light-receiving element 16*a* and a light-emitting element 16*b*. In the printer 10, print timing is controlled in accordance with detection results of the optical sensor 16.

1-2. Control Unit of Printer (FIG. 3)

Description will be provided on a control unit of the printer of the first embodiment. FIG. 3 is a functional block diagram of a control unit 100 of the printer 10 in FIG. 1.

Figure 3:
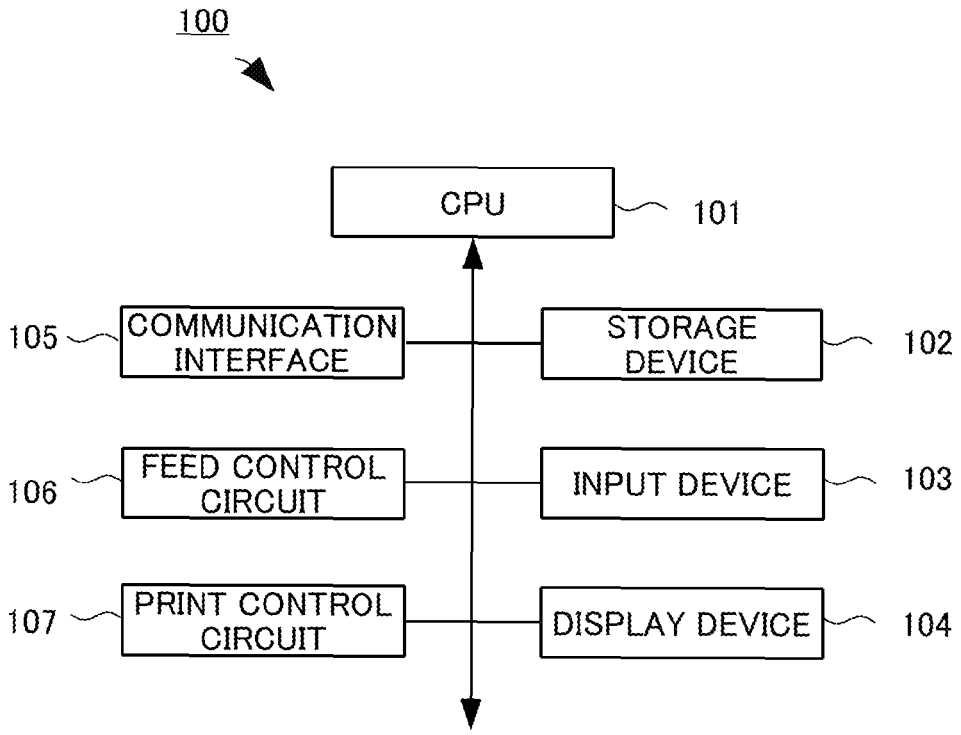
FIG. 3 is a functional block diagram of a control unit 100 of the printer in FIG. 1.

As illustrated in FIG. 3, the control unit 100 includes a central processing unit (CPU) 101, a storage device 102, an input device 103, a display device 104, a communication interface 105, a feed control circuit 106, and a print control circuit 107.

The storage device 102 includes, for example, a ROM, a RAM, and an electrically erasable programmable read-only memory (EEPROM). The storage device 102 stores a program (hereinafter, called firmware) of an application for controlling a process (e.g., print process) of the printer 10, data to be referred by the CPU 101, and data generated by the CPU 101.

The CPU 101 executes the firmware stored in the storage device 102 to actualize a function of the printer 10.

The input device 103 is, for example, an input button, a touch panel, or a combination thereof.

The display device 104 is a liquid crystal display, for example.

The communication interface 105 is configured to control communication between the printer 10 and an external apparatus. The communication interface 105 is a wired interface, a wireless interface, a near field communication wireless communication interface (e.g., an NFC) or a combination thereof. The external apparatus is, for example, a computer, a cellular phone, a flash memory (e.g., a universal serial bus (USB) memory), or a combination thereof.

The feed control circuit 106 is configured to control rotation of the platen roller 11. When a control signal (e.g., a pulse signal) for controlling driving of a stepping motor is received from the CPU 101, the feed control circuit 106 drives the stepping motor in accordance with the control signal.

The print control circuit 107 is configured to control heating of the heating elements E1 to E12. When a control signal for controlling heating of the heating elements E1 to E12 is received from the CPU 101, the print control circuit 107 applies voltage selectively to the heating elements E1 to E12 in accordance with the control signal. The heating elements E1 to E12 to which the voltage is applied generates heat.

1-3. Control Mode of Heating Element

Description will be provided on a heating element control mode of a first embodiment. The heating element control mode of the first embodiment includes a first control mode and a second control mode.

1-3-1. First Control Mode (FIG. 4)

The first control mode will be described.

Figure 4:
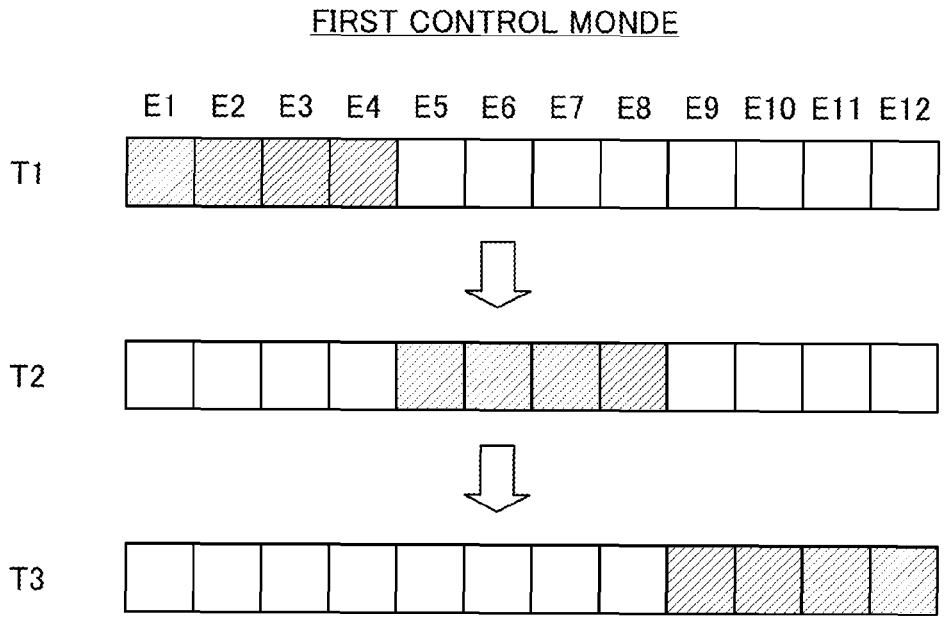
FIG. 4 is an explanatory view of a first control mode of the first embodiment.

FIG. 4 is an explanatory view of the first control mode of the first embodiment.

With the first control mode, the heating elements E1 to E12 are divided into a plurality of first groups as illustrated in FIG. 4. Specifically, the heating elements E1 to E12 are divided into a first group consisting of the heating elements E1 to E4, another first group consisting of the heating elements E5 to E8, and another first group consisting of the heating elements E9 to E12.

At timing T1, only the first group consisting of the heating elements E1 to E4 is heated. Here, heating elements corresponding to print dots among the heating elements E1 to E4 of the first group are heated.

At timing T2 subsequent to timing T1, only the first group consisting of the heating elements E5 to E8 is heated. Here, heating elements corresponding to print dots among the heating elements E5 to E8 of the first group are heated.

At timing T3 subsequent to timing T2, only the first group consisting of the heating elements E9 to 12 is heated. Here, heat is generated by heating elements corresponding to print dots among the heating elements E9 to E12 of the first group are heated.

In short, with the first control mode, the heating elements E1 to E12 are divided into the plurality of first groups.

Each of the first groups includes two or more adjacent heating elements (e.g., E1 to E4). Then, the print head 12 is controlled so that print dots on a single print line are printed on the print medium PM at different timings T1 to T3 for the respective first groups. In other words, in the first control mode, the heating elements heated at a single timing are located adjacently (i.e., such heating elements are arranged continuously).

1-3-2. Second Control Mode (FIG. 5)

The second control mode will be described.

Figure 5:
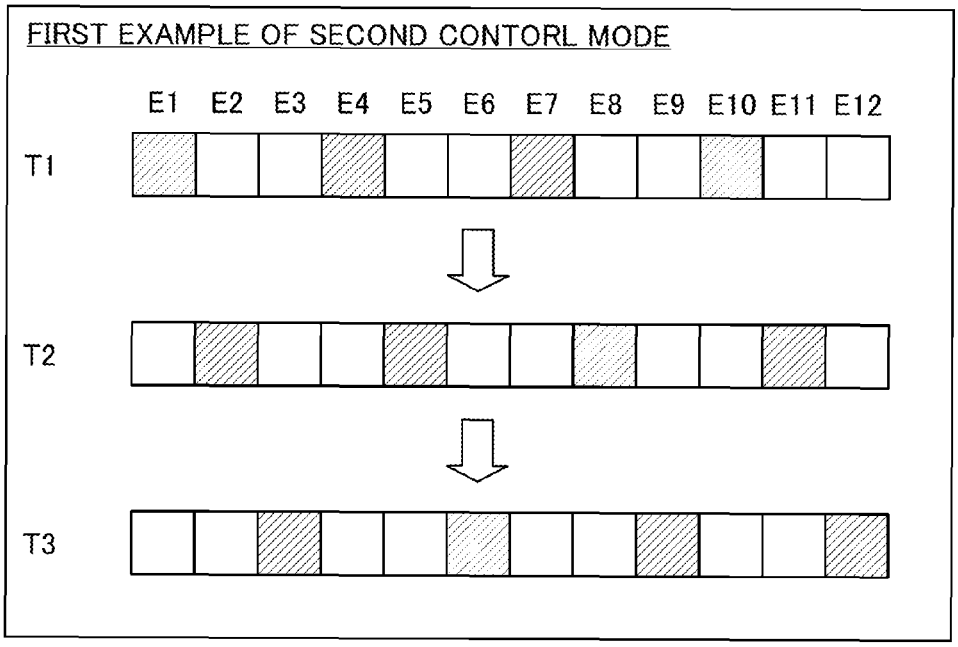
FIG. 5 is an explanatory view of a second control mode of the first embodiment.
Figure 5:
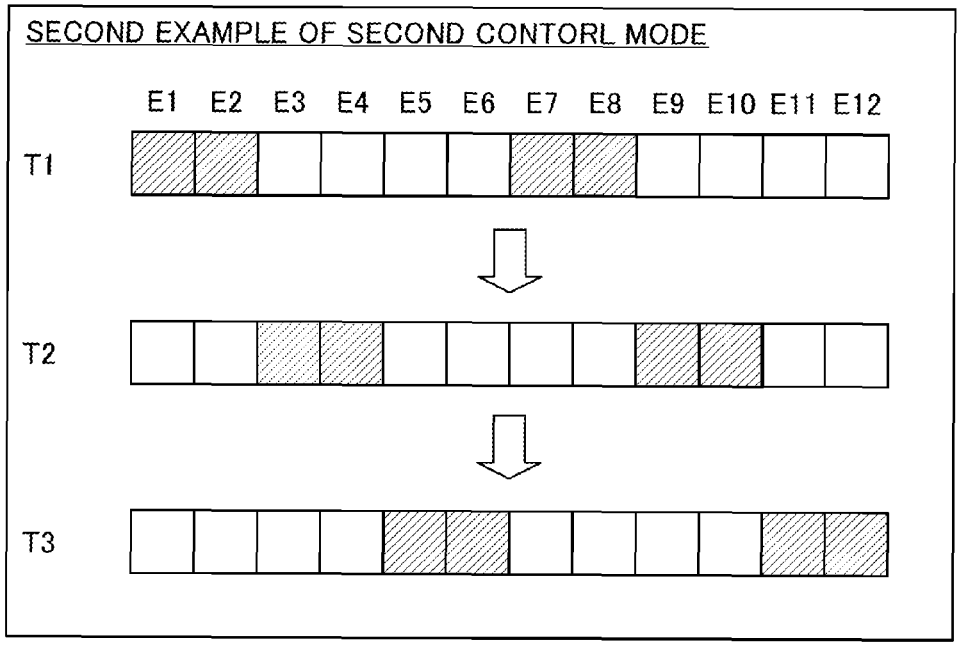

FIG. 5 is an explanatory view of the second control mode of the first embodiment.

In a first example of the second control mode, the heating elements E1 to E12 are divided into a plurality of second groups as illustrated in FIG. 5. Specifically, the heating elements E1 to E12 are divided into a second group consisting of the heating elements E1, E4, E7, and E10, another second group consisting of the heating elements E2, E5, E8, and E11, and another second group consisting of the heating elements E3, E6, E9, and E12.

In other words, with the first example of the second control mode, all the heating elements heated at a single timing are spaced apart (i.e., such heating elements are arranged discontinuously) from one another.

At timing T1, only the second group consisting of the heating elements E1, E4, E7, and E10 is heated.

At timing T2 subsequent to timing T1, only the second group consisting of the heating elements E2, E5, E8, and E11 is heated.

At timing T3 subsequent to timing T2, only the second group consisting of the heating elements E3, E6, E9, and E12 is heated.

In a second example of the second control mode, the heating elements E1 to E12 are divided into a plurality of second groups. Specifically, the heating elements E1 to E12 are divided into a second group consisting of the heating elements E1, E2, E7, and E8, another second group consisting of the heating elements E3, E4, E9, and E10, and another second group consisting of the heating elements E5, E6, E11, and E12. In other words, in the second example of the second control mode, the heating elements heated at a single timing include a plurality of combinations each having two adjacent heating elements and such combinations are spaced apart (i.e., such heating elements are arranged discontinuously) from one another.

At timing T1, only the second group consisting of a combination of the heating elements E1 and E2 and a combination of the heating elements E7 and E8 is heated.

At timing T2 subsequent to timing T1, only the second group consisting of a combination of the heating elements E3 and E4 and a combination of the heating elements E9 and E10 is heated.

At timing T3 subsequent to timing T2, only the second group consisting of a combination of the heating elements E5 and E6 and a combination of the heating elements E11 and E12 is heated.

In short, in the second control mode, the plurality of heating elements E1 to E12 are divided into the plurality of second groups. Each of the second groups includes two or more mutually-separated heating elements (e.g., E1, E4, E7, and E10). Then, the print head 12 is controlled so that print dots on a single print line are printed on the print medium PM at different timings T1 to T3 for the respective second groups. In other words, in the second control mode, at least a part of the heating elements is heated at a single timing is spaced apart (i.e., such heating elements are arranged discontinuously).

1-4. Flow of Print Process (FIGS. 6 to 9)

Figure 6:
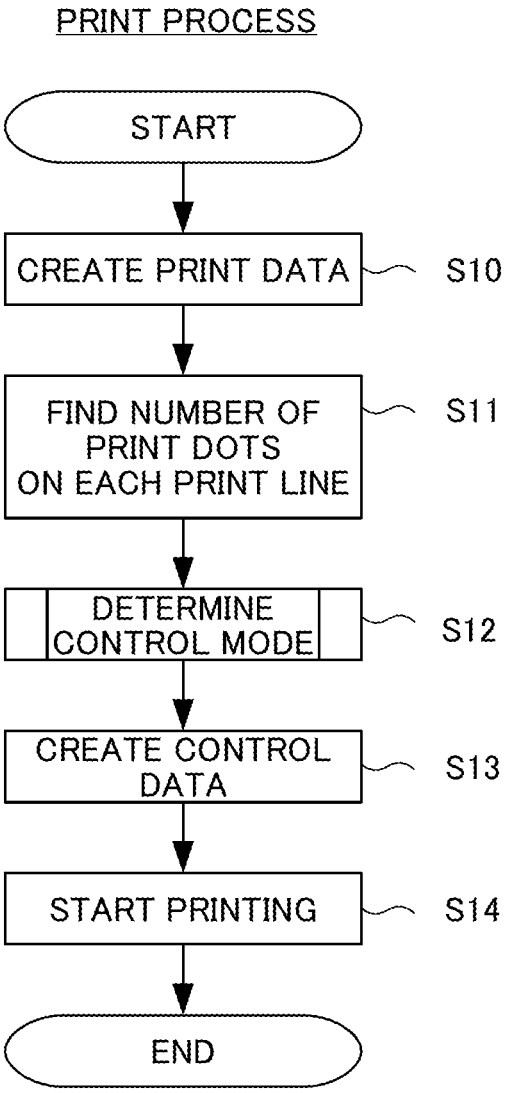
FIG. 6 is a flowchart illustrating flow of a print process of the first embodiment.
Figure 7:
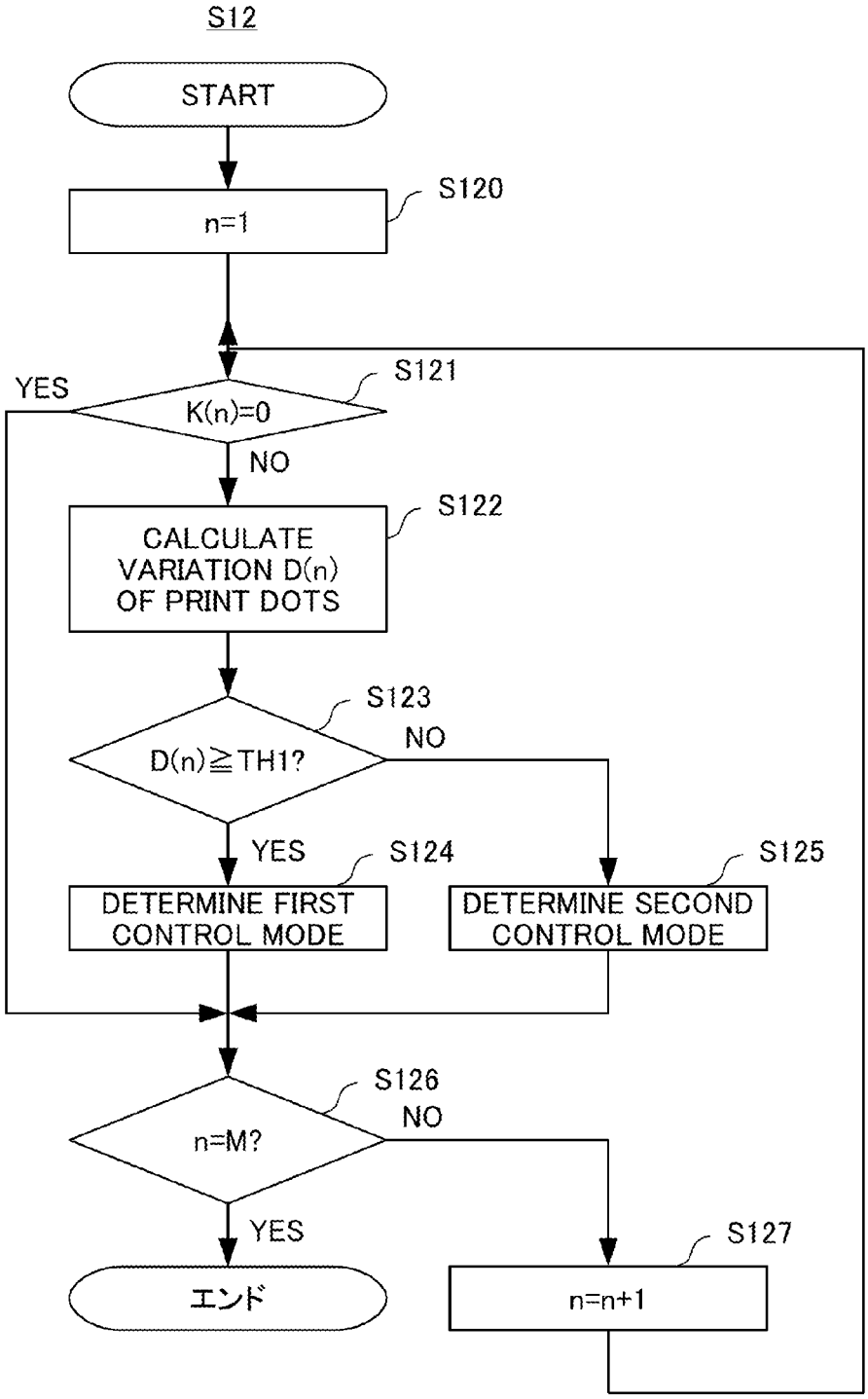
FIG. 7 is a flowchart illustrating detailed flow of control mode determination (S12 in FIG. 6) of the first embodiment.
Figure 8:
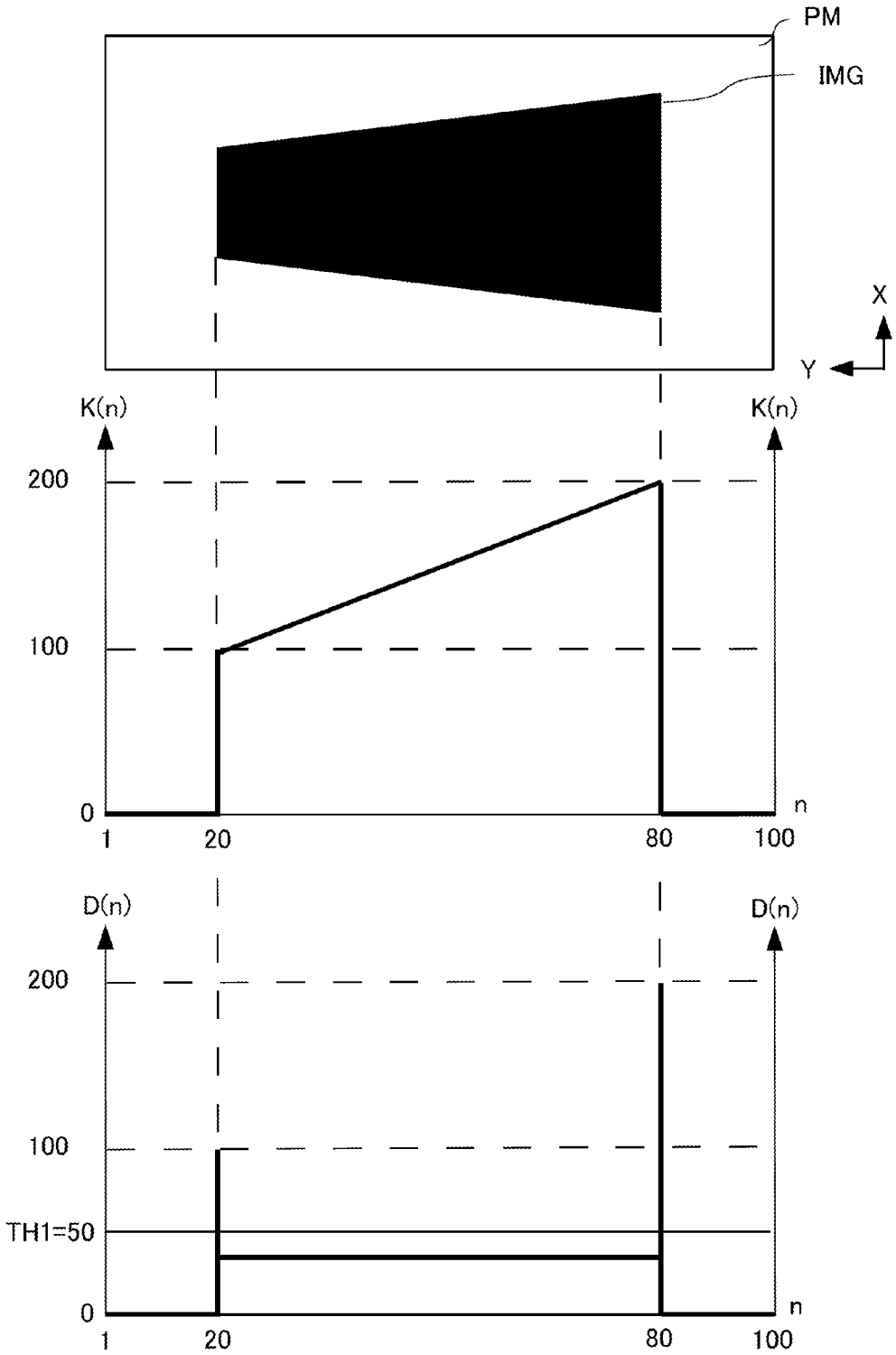
FIG. 8 is an explanatory view of the control modes corresponding to the flowchart in FIG. 7.

Description will be provided on flow of a print process of the first embodiment. FIG. 6 is a flowchart illustrating the flow of the print process of the first embodiment. FIG. 7 is a flowchart illustrating detailed flow of a control mode determination process (S12 in FIG. 6) of the first embodiment. FIG. 8 is an explanatory view of control modes corresponding to the flowchart in FIG. 7. FIG. 9 is a table showing an example of control data to be created in a control data creation process (S13 in FIG. 6) of the first embodiment.

Each step in FIGS. 6 and 7 is a part of a process when the CPU 101 executes the firmware.

In description with FIGS. 7 to 9, variable n (n is integer being 1 or larger) represents an identification number of a print line, constant M represents the maximum value of n (i.e., the number of print lines included in print data), K(n) represents the number of print dots on a print line L(n), D(n) represents a variation of print dots on the print line L(n), and TH1 represents a first threshold value.

The variation D(n) of print dots on the print line L(n) is obtained as an absolute value of a difference between the number K(n) of print dots on the print line L(n) and the number K(n−1) of print dots on a print line L(n−1) directly preceding the print line L(n), or a difference between the number K(n) and the number K(n+1) of print dots on a print line L(n+1) directly following the print line L(n).

As illustrated in FIG. 6, first, the CPU 101 creates print data (S10). Specifically, the CPU 101 receives data of an image to be printed (hereinafter, called image data) from a computer via the communication interface 105.

Next, the CPU 101 converts the received image data into print data. The print data includes print dot data corresponding to the heating elements E1 to E12 for each print line.

Next, the CPU 101 stores the print data in the storage device 102.

Next, the CPU 101 specifies the number of print dots on each print line (S11).

Specifically, the CPU 101 specifies the number of print dots on each print line included in print date stored in the storage device 102 at the step S10.

In FIG. 8, since the number M of print lines included in the print data is 100, the variable n is an integer between 1 and 100 inclusive.

The numbers K(1) to K(19) of print dots on print lines L(1) to L(19) are 0 and the number K(20) of print dots on a print line L(20) is 100. Between print lines L(21) and L(79), the number K(n) of print dots gradually increases from the number K(21) to the number K(79), that is, from 100 toward 200. The number K(80) of print dots on a print line L(80) is 200 and the numbers K(81) to K(100) of print dots on print lines L(81) to L(100) are 0.

Next, the CPU 101 determines a control mode (S12).

Detailed flow of S12 will be described with reference to FIG. 7.

As illustrated in FIG. 7, the CPU 101 sets 1 as an initial value to the variable n (S120). Accordingly, a print line L(1) at the top is set as a print line for which a control mode is to be determined (hereinafter, called a target line).

Next, the CPU 101 determines whether or not the number K(n) of print dots on the target line L(n) is 0, that is, whether or not the target line L(n) includes print dots (S121).

When the number K(n) of print dots on the target line L(n) is 0 (YES at S121), the CPU 101 performs the step S126 without performing the steps S122 to S125. In this case, since the control mode is not determined, the target line L(n) is recognized as a print line without including a print dot, that is, recognized as non-print target.

Next, the CPU 101 calculates a variation D(n) of print dots between the target line and a reference line (S122).

The reference line represents a print line adjacent to the target line L(n), that is, a print line L(n−1) directly preceding the target line L(n) or a print line L(n+1) directly following the target line L(n).

Specifically, the CPU 101 calculates, as the variation D(n), a first absolute value of a difference between the number K(n) of print dots on the target line L(n) and the number K(n−1) of print dots on the reference line L(n−1) directly preceding the target line L(n).

Here, when the variable n is equal to 1 (i.e., the minimum value), the variation D(n) is set to be equal to the number K(n) of print dots.

After the target line L(n) providing the first absolute value being equal to or larger than the first threshold value TH1 is found, the CPU 101 calculates, as the variation D(n), a second absolute value of a difference between the number K(n) of print dots on the target line L(n) and the number K(n+1) of print dots on the reference line L(n+1) directly following the target line L(n). Here, when the variable n is equal to 100 (i.e., the maximum value), the variation D(100) is set to be equal to the number K(100) of print dots.

After the target line (n) providing the second absolute value being equal to or larger than the first threshold value TH1 is found, the CPU 101 calculates again, as the variation D(n), the first absolute value and the second absolute value alternately.

In the case of FIG. 8, variations D(1) to D(19) of print dots on the target lines L(1) to L(19) are 0, a variation D(20) of print dots on the target line L(20) is 100, variations D(21) to D(79) of print dots on the target lines L(21) to L(79) are equal to a constant value below 100, a variation D(80) of print dots on the target line L(80) is 200, and variations D(81) to D(100) of print dots on the target lines L(81) to L(100) are 0.

Next, CPU 101 compares the variation D(n) with the first threshold value TH1 (S123).

When the variation D(n) is equal to or larger than the first threshold value TH1 (YES at S123), the CPU 101 determines the target line L(n) as a print line including an edge portion of an image IMG (hereinafter, called an edge line) and determines the first control mode as a control mode for the edge line (S124).

When the variation D(n) is smaller than the first threshold value TH1 (NO at S123), the CPU 101 determines the target line L(n) as a print line without including an edge portion of the image IMG (hereinafter, called a non-edge line) and determines the second control mode as a control mode for the non-edge line (S125).

In the case of FIG. 8, the first threshold value TH1 is 50.

Regarding the target lines L(1) to L(19), since the numbers K(1) to K(19) of print dots are 0 (YES at S121), the CPU 101 does not determine a control mode for the target lines L(1) to L(19), that is, recognizes the target lines L(1) to L(19) as non-print targets.

Regarding the target line L(20), since the number K(20) of print dots is equal to 1 or larger (NO at S121) and the variation D(20) is equal to or larger than the first threshold value TH1 (YES at S123), the CPU 101 determines the first control mode as the control mode for the target line L(20) (S124).

Regarding the target lines L(21) to L(79), since the numbers K(21) to K(79) are equal to 1 or larger (NO at S121) and the variations D(21) to D(79) are smaller than the first threshold value TH1 (NO at S123), the CPU 101 determines the second control mode as the control mode for the target lines L(21) to L(79) (S125).

Regarding the target line L(80), since the number K(80) of print dots is equal to 1 or larger (NO at S121) and the variation D(80) is equal to or larger than the first threshold value TH1 (YES at S123), the CPU 101 determines the first control mode as the control mode for the target line L(80) (S124).

Regarding the target lines L(81) to L(100), since the numbers K(81) to K(100) of print dots are 0 (YES at S121), the CPU 101 does not determine the control mode for the target lines L(81) to L(100), that is, recognizes the target lines L(81) to L(100) as non-print targets.

In short, regarding the print line L(n) that provides the number K(n) of print dots being equal to or larger than 1 (i.e., the print line L(n) to be a print target), the CPU 101 determines the first control mode as the control mode for an edge line that provides the variation D(n) being equal to or larger than the first threshold value TH1, and determines the second control mode as the control mode for a non-edge line that provides the variation D(n) smaller than the first threshold value TH1.

In other words, the CPU 101 determines the target line L(n) that provides the variation D(n) being equal to or larger than the first threshold value TH1 as the edge line and determines the target line L(n) that provides the variation D(n) smaller than the threshold value TH1 as the non-edge line. Then, the CPU 101 determines the first control mode as the control mode for the target line L(n) that is determined as the edge line and determines the second control mode as the control mode for the target line L(n) that is determined as the non-edge line.

Next, the CPU determines whether or not the variable n reaches the maximum value M (being 100 in the case of FIG. 8) (S126).

When the variable n is smaller than the maximum value M (NO at S126), the CPU 101 increments the variable n by 1 (i.e., the target line L(n) is shifted by one print line) (S127). Subsequently, the CPU 101 performs the steps S121 to S126 on the new target line L(n).

When the variable n is equal to the maximum value M (YES at S126), the CPU 101 ends the processes in FIG. 7 and performs the step S13 in FIG. 6.

As illustrated in FIG. 6, when the processes in FIG. 7 (i.e., the step S12) are completed, the CPU 101 creates the control data (S13).

As illustrated in FIG. 9, the control data includes a "print line" field and a "control mode" field.

Information for identifying print lines (hereinafter, called line ID) is stored in the "print line" field.

Flags indicating the control modes determined by the CPU 101 at the step S12 are stored in the "control mode" field. Here, flag 0 indicates that the control mode is not determined, that is, that the corresponding print line does not include a print dot, flag 1 indicates the first control mode, and flag 2 indicates the second control mode. After the control data is created, the CPU 101 stores the created control data in the storage device 102.

Next, the CPU 101 starts printing (S14).

Specifically, the CPU 101 sends a control signal to the print control circuit 107 in accordance with the information in the "control mode" field of the control data stored in the storage device 102 at the step S13. The print control circuit 107 applies voltage individually to the heating elements E1 to E12 in accordance with the control signal sent from the CPU 101. Consequently, the heating elements E1 to E12 generate heat in accordance with the control mode (the first control mode or the second control mode) set for each print line.

Here, for the print line with the flag "0" stored in the "control mode" field thereof, the print control circuit 107 does not apply voltage to any of the heating elements E1 to E12. Consequently, no image is printed on such print line.

After the printing (S14) is completed, the print medium PM on which the image IMG in FIG. 8 has been printed is ejected through the ejection port 17.

1-5. Summary

The first embodiment is summarized as follows.

According to the printer 10 of the first embodiment, an image IMG is printed on a print medium PM based on the print data including print dot data for each of the plurality of print lines.

The printer 10 includes the print head 12 including the plurality of heating elements arranged along direction X of the print lines, and the CPU 101 (an example of a controller) that specifies the number of print dots on each print line and determines the first control mode or the second control mode as the control mode of the heating elements for printing on each print line in accordance with the found number of print dots.

In the first control mode dividing the heating elements into the plurality of first groups, the CPU 101 controls the heating elements to generate heat at a different timing for each first group. Each first group includes two or more adjacent heating elements.

In the second control mode dividing the heating elements into the plurality of second groups, the CPU 101 controls the heating elements to generate heat at a different timing for each second group. Each second group includes two or more heating elements at least two of which are spaced apart.

Two or more heating elements of each first group are adjacent to each other. In other words, in the first control mode, the heating elements heated at a single timing are located adjacently (i.e., such heating elements are arranged continuously). Two or more heating elements of a single first group are heated at the same timing. Heating elements of different first groups are heated respectively at different timing. Accordingly, on the print line printed in the first control mode, steps appear only at boundaries between the respective first groups (at a position between the heating elements E4 and E5 and a position between the heating elements E8 and E9 in FIG. 4). Accordingly, steps do not stand out on the image IMG.

On the other hand, in the first control mode, heating elements are heated at each timing are congregated. Thus, temperature of heating elements which are not heated is likely decreased. Accordingly, variations in density are likely appeared on the image IMG on the print line printed in the first control mode.

At least two heating elements among the heating elements of the second group are spaced apart. In other words, in the second control mode, at least a part of the heating elements is heated at a single timing is spaced apart (i.e., such heating elements are arranged discontinuously). Two or more heating elements of a second group are heated at the same timing. Heating elements of different second groups are heated respectively at different timings. Accordingly, on the print line printed in the second control mode, steps appear at positions corresponding to boundaries between the respective second groups (at positions of all the heating elements E1 to E12 in the first example of the second control mode in FIG. 5, and at positions of the heating elements E2, E4, E6, E8, and E10 in the second example of the second control mode). Thus, more steps appear in the case of printing in the second control mode than those in steps appearing in the case of printing in the first control mode.

On the other hand, in the second control mode, heating elements heated at each timing are dispersed. Accordingly, variations in density are unlikely appeared on the image IMG on the print line printed in the second control mode.

As described above, the first control mode has an advantage of less appearing of steps, while having a disadvantage of more variations in density. In contrast, the second control mode has an advantage of less variation in density, while having a disadvantage of more appearing of steps.

In the present embodiment, a control mode being appropriate in accordance with the number of print dots is applied to each print line selected from the two kinds of control modes (i.e., first and second control modes) in which a plurality of heating elements are divided into a plurality groups for each print line and the respective groups are heated at different timings. Accordingly, this embodiment has advantages of the first and second control modes without disadvantages thereof. Consequently, it is possible to suppress power consumption of the printer 10 and prevent deterioration of print quality of an image IMG printed on a print medium PM.

The CPU 101 of the first embodiment determines based on print data whether each print line is an edge line including an edge portion of an image or a non-edge line including a non-edge portion of the image. Then the CPU 101 determines the first control mode as a control mode for the edge line and the second control mode as a control mode for the non-edge line.

In this case, since the first control mode is applied to the edge line, two or more adjacent heating elements generate heat. Accordingly, steps stand out less at the edge portion. Thus, it is possible to prevent deterioration of print quality at the edge portion of the image IMG.

Further, since the second control mode is applied to the non-edge line, at least two separately-located heating elements among two or more heating elements generate heat. A heating element (without generating heat) located between heat-generating heating elements is heated with heat generated by the heat-generating heating elements. Accordingly, temperature variations of the heating elements can be suppressed. Thus, it is possible to prevent deterioration of print quality at the non-edge portion of the image IMG.

The CPU 101 of the first embodiment calculates, among the print lines, a variation between the number of print dots of a target line for which a control mode is to be determined and the number of print dots of a reference line adjacent to the target line. Then, the CPU 101 determines the target line as the edge line when the variation is equal to or larger than a predetermined first threshold value and determines the target line as the non-edge line when the variation is smaller than the first threshold value.

In this case, since the first control mode is applied to the edge line, two or more adjacent heating elements generate heat. Accordingly, steps stand out less at the edge portion of the image IMG. Thus, it is possible to prevent deterioration of print quality at the edge portion of the image IMG.

Further, since the second control mode is applied to the non-edge line, at least two separately-located heating elements among two or more heating elements generate heat.

A heating element (without generating heat) located between heat-generating heating elements is heated with heat generated by the heat-generating heating elements.

Accordingly, temperature variations of the heating elements can be suppressed. Thus, it is possible to prevent deterioration of print quality at the non-edge portion of the image IMG.

2. Second Embodiment

A second embodiment will be described. In the first embodiment, description is provided on the example to determine of two control modes (i.e., first and second control modes) as a control mode for each print line. In the second embodiment, description will be provided on an example to determine any of three control modes (i.e., first to third control modes) as a control mode for each print line.

Here, description being the same as in the first embodiment will not be repeated.

Figure 10:
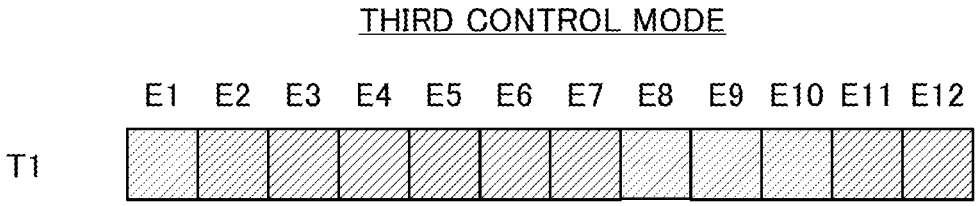
FIG. 10 is an explanatory view of a third control mode of a second embodiment.

2-1. Control Mode of Heating Elements (FIG. 10)

A control mode of the heating elements of the second embodiment will be described.

The control mode of the heating elements of the second embodiment includes first to third control modes.

Here, the first and second control modes are the same as those in the first embodiment.

The third control mode of the second embodiment will be described. FIG. 10 is an explanatory view of the third control mode of the second embodiment.

In the third control mode, all the heating elements E1 to E12 are heated at a single timing T1 as illustrated in FIG. 10.

That is, the third control mode is different from the first and second control modes in that the heating elements E1 to E12 are heated at the same timing without being divided into groups.

2-2. Flow of Print Process (FIGS. 11 to 13)

Description will be provided on flow of a print process of the second embodiment.

Figure 11:
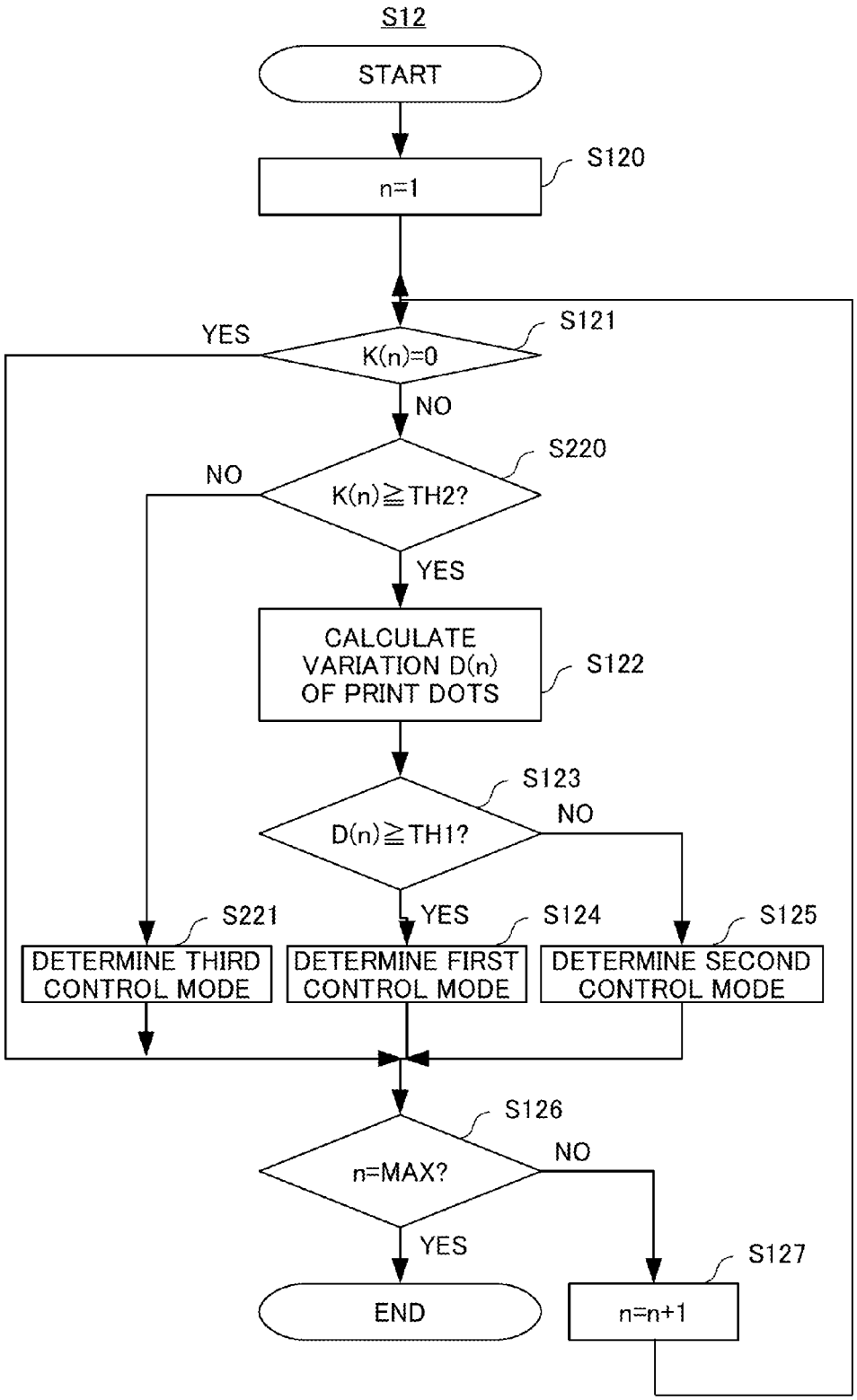
FIG. 11 is a flowchart illustrating a detailed flow to determine a control mode of the second embodiment (S12 in FIG. 6).
Figure 12:
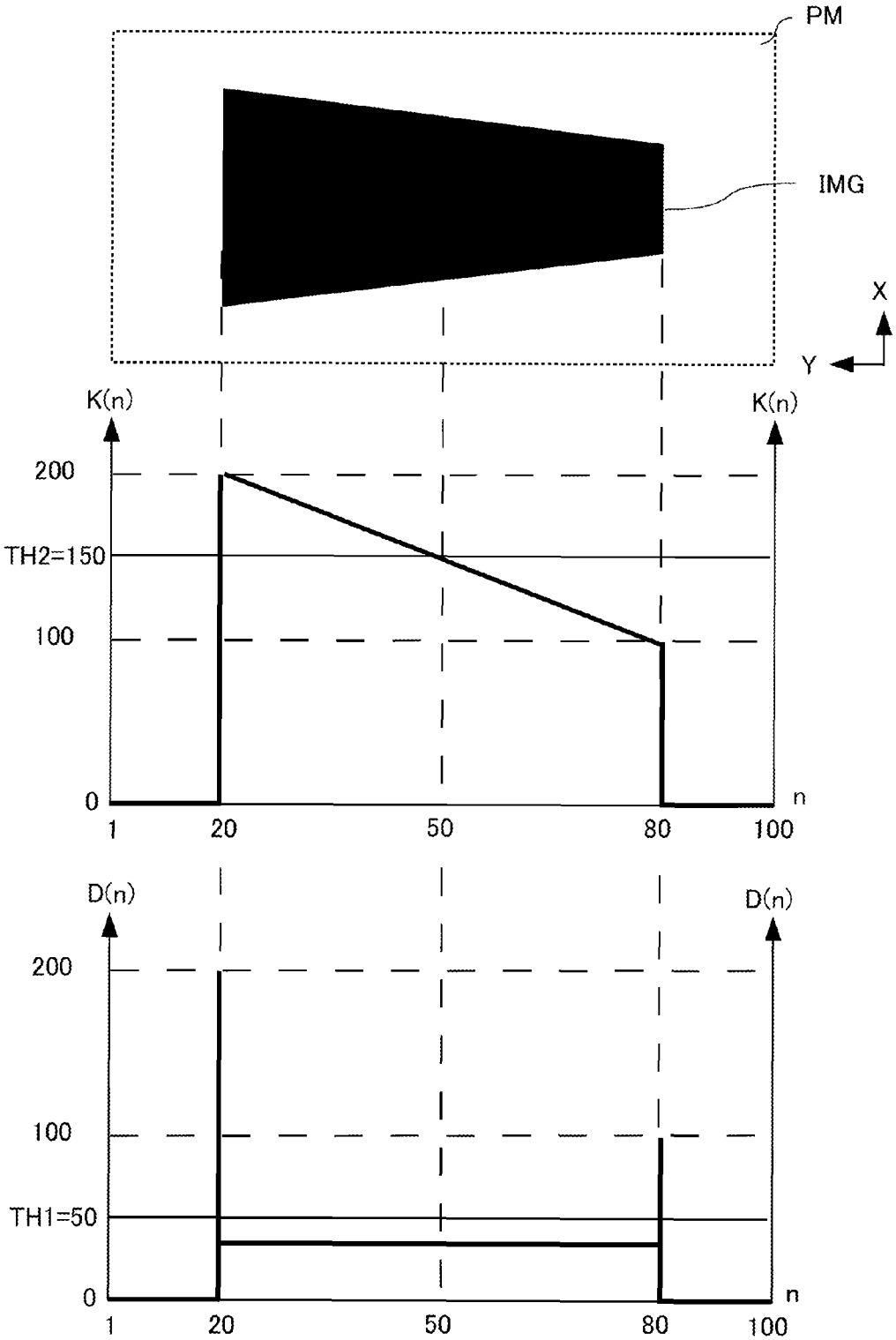
FIG. 12 is an explanatory view of the control modes corresponding to the flowchart in FIG. 11.

FIG. 11 is a flowchart illustrating detailed flow of a control mode determination process (S12 in FIG. 6) of the second embodiment. FIG. 12 is an explanatory view of control modes corresponding to the flowchart in FIG. 11. FIG. 13 is a table showing an example of control data to be created in a control data creation process (S13 in FIG. 6) of the second embodiment.

Each step in FIG. 11 is a part of a process when the CPU 101 executes the firmware.

In description with FIGS. 11 to 13, variable n, constant M, K(n), D(n), and TH1 represent the same as in the first embodiment, while TH2 represents a second threshold value.

As illustrated in FIG. 11, after performing the steps S120 and S121 as in the first embodiment, the CPU 101 compares the number K(n) of print dots on the target line L(n) with the second threshold value (S220).

When the number K(n) of print dots on the target line L(n) is smaller than the second threshold value TH2(NO at S220), the CPU 101 determines the third control mode as a control mode for the target line L(n) (S221).

When the number K(n) of print dots on the target line L(n) is equal to or larger than the second threshold value TH2 (YES at S220), the CPU 101 performs the steps S122 to S125 as in the first embodiment.

In the case of FIG. 12, the first threshold value TH1 is 50 and the second threshold value TH2 is 150.

Regarding the target lines L(1) to L(19), since the numbers K(1) to K(19) of print dots are 0 (YES at S121), the CPU 101 does not determine the control mode for the target lines L(1) to L(19), that is, recognizes the target lines L(1) to L(19) as non-print targets. Regarding the target line L(20), since the number K(20) of print dots is equal to or larger than the second threshold value TH2 (NO at S121 and YES at S220) and the variation D(20) is equal to or larger than the first threshold value TH1 (YES at S123), the CPU 101 determines the first control mode as the control mode for the target line L(20) (S124).

Regarding the target lines L(21) to L(50), since the numbers K(21) to K(50) are equal to or larger than the second threshold value TH2 (NO at S121 and YES at S220) and the variations D(21) to D(50) are smaller than the first threshold value TH1 (NO at S123), the CPU 101 determines the second control mode as the control mode for the target lines L(21) to L(50) (S125).

Regarding the target lines L(51) to L(80), since the numbers K(51) to K(80) of print dots are equal to or larger than 1 (NO at S121) and smaller than the second threshold value TH2 (NO at S220), the CPU 101 determines the third control mode as the control mode for the target lines L(51) to L(80) (S221).

Regarding the target lines L(81) to L(100), since the numbers K(81) to K(100) of print dots are 0 (YES at S121), the CPU 101 does not determine the control mode for the target lines L(81) to L(100), that is, recognizes the target lines L(81) to L(100) as non-print targets.

Subsequently, the CPU 101 creates the control data (S13 in FIG. 6).

As illustrated in FIG. 13, the control data in the second embodiment is different from the control data (FIG. 9) of the first embodiment in that flag 3 indicating the third control mode is stored in the "control mode" field in addition to flag 0 indicating that the control mode is not determined, flag 1 indicating the first control mode, and flag 2 indicating the second control mode.

2-3. Summary

The second embodiment is summarized as follows.

According to the printer 10 of the second embodiment, an image IMG is printed on a print medium PM based on the print data including print dot data for each of the plurality of print lines.

The printer 10 includes the print head 12 including the plurality of heating elements arranged along direction X of the print lines, and the CPU 101 (an example of the controller) that specifies the number of print dots on each print line and determines any of the first to third control modes as the control mode of the heating elements for printing on each print line in accordance with the found number of print dots.

In the first control mode dividing the heating elements into the plurality of first groups the CPU 101 controls the heating elements to generate heat at different timings for each first groups. Each first group includes two or more adjacent heating elements.

In the second control mode dividing the heating elements into the plurality of second groups, the CPU 101 controls the heating elements of respective second groups to generate heat at different timings for each second group. Each second group includes two or more heating elements at least two of which are spaced apart.

In the third control mode, the CPU 101 controls the plurality of heating elements to generate heat at the same timing.

Similarly to the first embodiment, the first control mode has an advantage of less appearing of steps, while having a disadvantage of more variations in density. Similarly to the first embodiment, the second control mode has an advantage of less variation in density, while having a disadvantage of more appearing of steps.

In the third control mode, the heating elements corresponding to all print dots on a print line (i.e., all the heating elements are heated) generate heat at the same timing. Thus, the third control mode has an advantage less appearing of steps and variations in density on the print line. However, owing to restriction of power consumption of a battery or the like, the third control mode has a disadvantage that it is impossible to be adopted for a print line on which the number K(n) of print dots is equal to or larger than the second threshold value TH2.

In the present embodiment, a control mode being appropriate in accordance with the number of print dots is applied to each print line selected from the two kinds of control modes (i.e., first and second control modes) in which a plurality of heating elements are divided into a plurality of groups for each print line and the respective groups generate heated at different timings and the control mode (i.e., third control mode) in which the plurality of heating elements generate heat at the same timing. Accordingly, it is possible to obtain advantages of the first to third control modes while preventing disadvantages thereof. Consequently, it is possible to suppress power consumption of the printer 10 and prevent deterioration of print quality of an image IMG printed on a print medium PM.

The CPU 101 of the second embodiment calculates, among the print lines, a variation between the number of print dots of a target line for which a control mode is to be determined and the number of print dots of a reference line adjacent to the target line. Then, the CPU 101 determines the first control mode as the control mode for the target line when the variation is equal to or larger than a predetermined first threshold value and the number of print dots on the target line is equal to or larger than a predetermined second threshold value, determines the second control mode as the control mode for the target line when the variation is smaller than the first threshold value and the number of print dots on the target line is equal to or larger than the second threshold value, and determines the third control mode as the control mode for the target line when the number of print dots on the target line is smaller than the second threshold value.

In this case, since the first control mode is applied to a print line having a large number of print dots and a large variation of the print dots, two or more adjacent heating elements generate heat. Accordingly, steps stand out less at the portion of the image IMG where the variation is large. Thus, it is possible to prevent deterioration of print quality at such portion.

Further, since the second control mode is applied to a print line having a small variation of print dots, at least two separately-located heating among two or more heating elements generate heat. A heating element (without generating heat) located between heat-generating heating elements is heated with heat generated by the heat-generating heating elements. Accordingly, temperature variations of the heating elements can be suppressed. Thus, it is possible to prevent deterioration of print quality at the portion in the image IMG where the variation of print dots is small.

3. Third Embodiment

A third embodiment will be described. In the above embodiments, description is provided on the examples to determine a control mode of the print head 12. In the third embodiment, description will be provided on an example to determine, for each print line, a period of time (hereinafter, called a strobe period) during which voltage is applied to the heating elements generating heat for printing each print line in addition to the control mode of the print head 12.

Here, description being the same as in the above embodiments will not be repeated.

3-1. Control Pattern of Platen Roller (FIG. 14)

Description will be provided on control patterns of a platen roller of the third embodiment.

Figure 14:
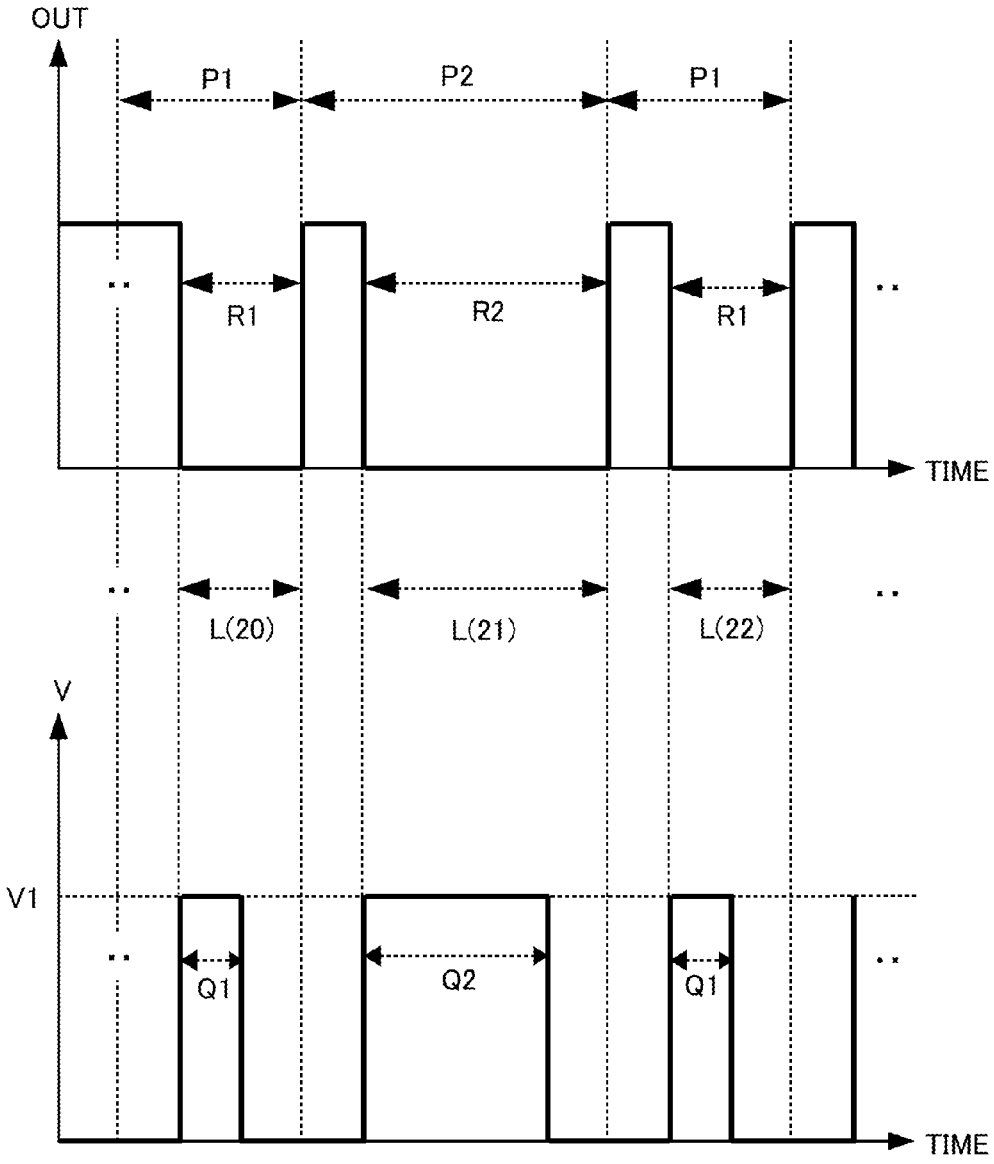
FIG. 14 is a time chart illustrating waveforms of a pulse signal to be sent to a feed control circuit 106 and voltage to be applied to heating elements by a CPU 101 of a third embodiment.

FIG. 14 is a time chart illustrating waveforms of a pulse signal to be sent by the CPU 101 to the feed control circuit 106 and voltage to be applied to heating elements, according to the third embodiment. The pulse signal is a control signal for controlling driving of the stepping motor.

In the third embodiment, the CPU 101 determines the control pattern of the platen roller 11 in addition to the control mode of the print head 12 in the step S12 in FIG. 6.

In FIG. 14, the vertical axis OUT represents output of the pulse signal, the vertical axis V represents voltage to be applied to the heating elements to generate heat, and the horizontal axis TIME represents time. A first pattern is represented by P1. A second pattern is represented by P2. A strobe period is represented by each of Q1 and Q2. A period of time (hereinafter, called a stop period) during which rotation of the platen roller 11 is stopped is represented by each of R1 and R2.

As illustrated in FIG. 14, the CPU 101 determines the first pattern P1 or the second pattern P2, for each print line L(n), as a pattern of a pulse signal to be sent to the feed control circuit 106 and voltage to be applied to the heating elements.

In the first pattern P1, after the platen roller 11 is rotated to feed a print medium PM by one print line, rotation of the platen roller 11 is kept stopped for the period R1 and voltage is applied to the heating elements for the period Q1 (Q1<R1) in the period R1 during which rotation of the platen roller 11 is kept stopped.

In the second pattern P2, after the platen roller 11 is rotated to feed the print medium PM by one print line, rotation of the platen roller 11 is kept stopped for the period R2 being longer than the period R1 and voltage is applied to the heating elements for the period Q2 (Q2<R2) being longer than the period Q1 in the period R2 during which the rotation of the platen roller 11 is kept stopped. Among the print lines to be printed on, the first pattern P1 is applied to print lines other than a print line directly following a print line to which the first control mode is applied, and the second pattern P2 is applied to the print line directly following the print line to which the first control mode is applied.

For example, for printing the image IMG in FIG. 12, the CPU 101 determines the first pattern P1 as the pattern for printing on the print line L(20) to which the first control mode is applied. In this pattern, the CPU 101 continues to apply voltage to the heating elements to generate heat during the period Q1. Accordingly, the heating elements continue to generate heat during the period Q1.

The CPU 101 determines the second pattern P2 as the pattern for printing on the print line L(21) directly following the print line L(20) to which the first control mode is applied. In this pattern, the CPU 101 continues to apply voltage to the heating elements to generate heat during the period Q2. Accordingly, the heating elements continue to generate heat during the period Q2.

Each of the strobe periods Q1 and Q2 corresponds to a period during which printing is performed (hereinafter, called a print period). That is, the print period in the second pattern P2 is longer than that in the first pattern P1.

The CPU 101 determines the first pattern P1 as the pattern for printing on the print line L(22) directly following the print line L(21) to which the second control pattern is applied. In this pattern, the CPU 101 continues to apply voltage during the period Q1. Accordingly, the heating elements continue to generate heat during the period Q1.

As illustrated in FIG. 14, the print line L(20) is printed in the first control mode. In the first control mode, temperature at the heating elements E1 to E4 having generated heat at timing T1 decreases at timings T2 to T3.

The print line L(21) is printed in the second control mode. Here, voltage is applied only during the period Q2 to the temperature-decreased heating elements E1 to E4 among the heating elements of the second group in the second control mode.

In general, print density of an image IMG printed on a print medium PM is proportional to the product of a strobe period and voltage applied to a heating element. Accordingly, at the print line L(21) with the strobe period Q2 being longer than the strobe period Q1, it is possible to prevent print density decrease due to temperature decrease of the heating elements E1 to E4.

In other words, average feeding speed of the print medium PM in the second pattern P2 (feeding distance of the print medium PM/required time of the second pattern P2) is lower than that in the first pattern P1 (feeding distance of the print medium PM/required time of the first pattern P1). That is, for printing on the print line directly following the print line to which the first control mode is applied, the CPU 101 reduces the feeding speed of the print medium PM compared to printing on other print lines. Accordingly, the print period for the print line L(21) to which the second pattern P2 is applied is longer than the print period for the print lines L(20) and L(22) to which the first pattern P1 is applied.

3-2. Summary

The third embodiment is summarized as follows.

The printer 10 of the third embodiment further includes the platen roller 11 (an example of a feed portion) that feeds the print medium PM.

The CPU 101 determines the first pattern P1 as a control pattern of the platen roller 11 for printing a print line for which the first control mode is determined as the control mode and determines the second pattern P2 with which the print period is longer than the first pattern P1 as a control pattern of the platen roller 11 for printing on a print line directly following the print line for which the first control mode is determined as the control mode.

As described above, in the first control mode, temperature of heating elements which do not generate heat is likely decreased. Accordingly, temperature of heating elements for printing a print line directly following a print line to which the first control mode is applied is lower than temperature for printing other print lines. Consequently, print density of the print line directly following the print line to which the first control mode is applied is likely decreased in comparison to print density of the other print lines.

In the third embodiment, the print period for the print line directly following the print line to which the first control mode is applied is longer than that for the print line to which the first control mode is applied. Accordingly, the strobe period for printing on the print line directly following the print line to which the first control mode is applied is longer than that for printing on the print line to which the first control mode is applied. The longer the strobe period is, the higher the print density of the image printed on the print medium PM is. Accordingly, the print density becomes high on the print line directly following the print line to which the first control mode is applied, so that print quality deterioration can be prevented.

3-3. Modified Example

A modified example of the third embodiment will be described.

In the modified example, so-called multi-strobe is performed for printing on a print line directly following a print line to which the first control mode is applied.

For example, the CPU 101 sends, to the print control circuit 107, a control signal for multi-strobe during the period R2 of the second pattern P2 in FIG. 14. Here, multi-strobe represents that voltage is applied multiple times to the same heating element (i.e., the same heating element generates heat multiple times) during rotation of the platen roller 11 is kept stopped. The print control circuit 107 controls the heating elements that correspond to print dots among the heating elements of the second group to generate heat multiple times in accordance with the control signal. Consequently, the strobe period when multi-strobe is performed becomes longer than that when multi-strobe is not performed.

Multi strobe may be performed at every timing (e.g., at timings T1 to T3 in FIG. 5) or only at the first timing (e.g., at timing T1 in FIG. 5).

According to the present modified example, since multi-strobe is performed for printing a print line directly following a print line to which the first control mode is applied, the strobe period becomes longer compared to the print line to which the first control mode is applied. Accordingly, at the print line directly following the print line to which the first control mode is applied, print density reduction due to temperature decrease of the heating elements can be prevented and power consumption can be suppressed.

4. Fourth Embodiment

A fourth embodiment will be described. In the third embodiment, description is provided on the example that a strobe period is determined for each print line. In the fourth embodiment, description will be provided on an example that voltage to be applied to heating elements is determined for each print line.

Here, description being the same as in the above embodiments will not be repeated.

4-1. Voltage Applied to Heating Element (FIG. 15)

Description will be provided on voltage to be applied to heating elements in the fourth embodiment.

Figure 15:
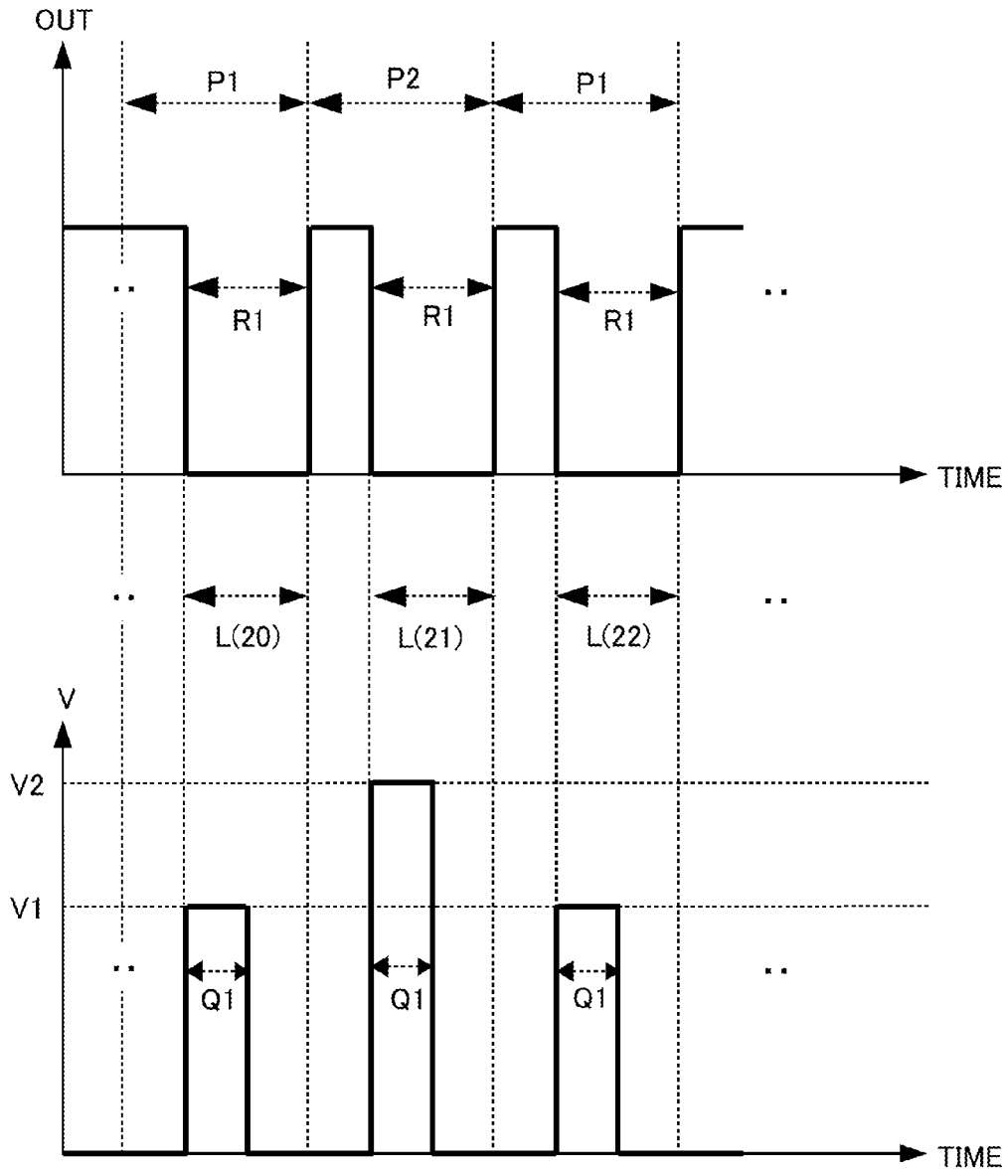
FIG. 15 is a time chart illustrating waveforms of a pulse signal to be sent to a feed control circuit 106 and voltage to be applied to heating elements, by a CPU 101 of a fourth embodiment.

FIG. 15 is a time chart illustrating waveforms of a pulse signal to be sent by the CPU 101 to the feed control circuit 106 and voltage to be applied to heating elements according to the fourth embodiment.

In the fourth embodiment, the CPU 101 determines, in the step S12 in FIG. 6, voltage to be applied to the heating elements E1 to E12 in addition to the control mode of the print head 12.

In FIG. 15, the vertical axis OUT represents output of the pulse signal, the vertical axis V represents voltage to be applied to the heating elements to generate heat, and the horizontal axis TIME represents time. The patterns P1, P2 and the periods Q1 and R1 represent the same as in the third embodiment.

The patterns P1 and P2 of the third embodiment have the common stop period R1 and the common strobe period Q1, and are different from the voltage V1 and V2 to be applied to the heating elements in the third embodiment.

Specifically, as illustrated in FIG. 15, the CPU 101 determines a first voltage V1 or a second voltage V2 being higher than the first voltage V1 as a voltage to be applied to the heating elements E1 to E12 for each print line L(n). The CPU 101 sends, to the print control circuit 107, a control signal for continuing to apply the determined voltage (the first voltage V1 or the second voltage V2) to the heating elements E1 to E12 for the period Q1.

Among the print lines to be printed on, the first voltage V1 is applied to print lines other than a print line directly following a print line to which the first control mode is applied, and the second voltage V2 is applied to the print line directly following the print line to which the first control mode is applied.

For example, for printing the image IMG in FIG. 12, the CPU 101 determines the first voltage V1 as a voltage to be applied to the heating elements E1 to E12 for printing on the print line L(20) to which the first control mode is applied.

The CPU 101 determines the second voltage V2 as a voltage to be applied to the heating elements E1 to E12 for printing on the print line L(21) directly following the print line L(20) to which the first control mode is applied.

The CPU 101 determines the first voltage V1 as a voltage to be applied to the heating elements E1 to E12 for printing on the print line L(22) following the print line L(21) to which the second voltage V2 is applied.

As illustrated in FIG. 15, the first voltage V1 is applied to the heating elements E1 to E12 for printing on the print line L(20). In the first control mode, temperature of the heating elements E1 to E12 decreases after the first voltage V1 is applied.

For printing on the print line L(21), the second voltage V2 being higher than the first voltage V1 is applied to the heating elements E1 to E12.

In general, print density of an image IMG printed on a print medium PM is proportional to the product of a strobe period and voltage applied to a heating element. Accordingly, at the print line L(21) with the second voltage V2 being higher than the first voltage V1 being applied to the heating elements, it is possible to prevent print density decrease due to temperature decrease of the heating elements E1 to E12.

In other words, for printing on a print line directly following a print line to which the first control mode is applied, the CPU 101 increases voltage to be applied to the heating elements E1 to E12 compared to printing on other print lines. Accordingly, even if the heating elements E1 to E12 are cooled down after printing on the print line to which the first control mode is applied, it is possible to prevent print density reduction of the print line directly following the print line to which the first control mode is applied.

4-2. Summary

The fourth embodiment is summarized as follows.

The CPU 101 of the fourth embodiment determines the first voltage V1 as a voltage to be applied to the heating elements for printing a print line for which the first control mode is determined as the control mode and determines the second voltage V2 being higher than the first voltage V1 as a voltage to be applied to the heating elements for printing a print line directly following the print line for which the first control mode is determined as the control mode.

As described above, in the first control mode, temperature of heating elements which do not generate heat is likely decreased. Accordingly, temperature of heating elements for printing on a print line directly following a print line to which the first control mode is applied is lower than temperature for printing on other print lines. Consequently, print density of the print line directly following the print line to which the first control mode is applied is likely decreased in comparison to that of the other print lines.

In the fourth embodiment, the voltage to be applied to the heating elements for printing on the print line directly following the print line to which the first control mode is applied is higher than that for printing on other print lines. The higher the voltage to be applied is, the higher the print density of the image printed on the print medium PM is. Accordingly, the print density becomes high on the print line directly following the print line to which the first control mode is applied, so that print quality deterioration can be prevented.

Further, in the fourth embodiment, since the strobe period Q1 for printing on the print line directly following the print line to which the first control mode is applied is the same as the strobe period Q1 for printing on the print line to which the first control mode is applied, the total print period can be shortened in comparison to the third embodiment.

5. Other Modified Examples

Although description of the above embodiments is provided on examples that the print medium PM is in a form of a continuous label, the form thereof is not limited thereto.

The print medium PM may be in a form of that a plurality of labels are temporarily stuck onto a continuous liner, in a form that radio frequency identification (RFID) is mounted therein, or in a form without having a stick layer (e.g., a tag, a wrist band, and the like).

Numerical examples (e.g., the number of heating elements included in the print head 12, the number of print lines, the number of adjacent heating elements in the second group, and values of the first threshold value TH1 and the second threshold value TH2) in the above embodiments are simply examples and the embodiments are not limited thereto.

Further, the first threshold value TH1 and the second threshold value TH2 may be changed based on a user's instruction. For example, when a user provides an instruction to change the threshold value TH1 and the threshold value TH2 using the input device 103, the CPU 101 stores the values based on the instruction in the storage device 102. Then, the CPU 101 refers the values stored in the storage device 102 at S123 in FIGS. 7 and 11 and S220 in FIG. 11. Thus, a print process is performed using the first threshold value TH1 and the second threshold value TH2 which are changed based on the user's instruction.

Although description of the above embodiments is provided on the example that the printer 10 creates print data from image data received via the communication interface 105, the embodiments are not limited thereto. The printer 10 may create print data based on a user's instruction, for example, received via the input device 103.

Description of the above embodiments is provided on the example that the printer 10 causes a thermosensitive layer to be colored for print. However, the above embodiments may be applied, for example, to a printer in which an image is transferred onto a print medium PM using an ink ribbon.

In the above, although description is provided in detail on the embodiments of the present invention, the scope of the present invention is not limited to the above embodiments. Further, the embodiments may be modified or varied variously without departing from the scope of the present invention. Further, the embodiments and modified examples described above may be combined.

REFERENCE SIGNS LIST

10: Printer
11: Platen roller
12: Print head
12*a*: Print face
13: Holder
16: Optical sensor
16*a*: Light-receiving element
16*b*: Light-emitting element
17: Ejection port
100: Control unit
101: CPU
102: Storage device
103: Input device
104: Display device
105: Communication interface
106: Feed control circuit
107: Print control circuit

The invention claimed is:

1. A printer configured to print an image on a print medium based on print data that includes print dot data for each of a plurality of print lines, comprising:

a print head including a plurality of heating elements arranged along a direction of the print lines; and a controller configured to find the number of print dots on each print line and determine a first control mode or a second control mode as a control mode of the heating elements for printing each print line based on the found number of print dots, wherein in the first control mode dividing the heating elements into a plurality of first groups the controller controls the plurality of heating elements to generate heat at a different timing for each first group including two or more adjacent heating elements, and in the second control mode dividing the heating elements into a plurality of second groups the controller controls the plurality of heating elements to generate heat at a different timing for each second group including two or more heating elements, at least two of which are spaced apart.

2. The printer according to claim 1, wherein the controller determines based on the print data whether each print line is an edge line being a print line including an edge portion of the image or a non-edge line being a print line including a non-edge portion of the image, and determines the first control mode as a control mode for the edge line, and determines the second control mode as a control mode for the non-edge line.

3. The printer according to claim 2, wherein the controller calculates, among the print lines, a variation between the number of print dots of a target line being a print line for which the control mode is to be determined and the number of print dots of a reference line being a print line adjacent to the target line, and determines the target line as the edge line when the variation is equal to or larger than a predetermined first threshold value, and determines the target line as the non-edge line when the variation is smaller than the first threshold value.

4. The printer according to claim 3, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

5. The printer according to claim 3, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

6. The printer according to claim 2, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

7. The printer according to claim 2, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

8. The printer according to claim 1, wherein the controller calculates, among the print lines, a variation between the number of print dots of a target line being a print line for which the control mode is to be determined and the number of print dots of a reference line being a print line adjacent to the target line, and determines the target line as the edge line when the variation is equal to or larger than a predetermined first threshold value, and determines the target line as the non-edge line when the variation is smaller than the first threshold value.

9. The printer according to claim 8, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

10. The printer according to claim 8, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

11. The printer according to claim 1, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

12. The printer according to claim 1, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

13. A printer configured to print an image on a print medium based on print data that includes print dot data for each of a plurality of print lines, comprising:

a print head including a plurality of heating elements arranged along a direction of the print lines; and a controller configured to find the number of print dots on each print line and determine any of first to third control modes as a control mode of the heating elements for printing each print line based on the found number of print dots, wherein in the first control mode dividing the heating elements into a plurality of first groups the controller controls the plurality of heating elements to generate heat at a different timing for each first group including two or more adjacent heating elements, in the second control mode dividing the heating elements into a plurality of second groups the controller controls the plurality of heating elements to generate heat at a different timing for each second group including two or more heating elements, at least two of which are spaced apart, and in the third control mode, the controller controls the plurality of heating elements to generate heat at the same timing.

14. The printer according to claim 13, wherein the controller calculates, among the print lines, a variation between the number of print dots of a target line being a print line for which the control mode is to be determined and the number of print dots of a reference line being a print line adjacent to the target line, and determines the first control mode as a control mode for the target line when the variation is equal to or larger than a predetermined first threshold value and the number of print dots on the target line is equal to or larger than a predetermined second threshold value, determines the second control mode as a control mode for the target line when the variation is smaller than the first threshold value and the number of print dots on the target line is equal to or larger than the second threshold value, and determines the third control mode as a control mode for the target line when the number of print dots on the target line is smaller than the second threshold value.

15. The printer according to claim 14, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

16. The printer according to claim 14, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

17. The printer according to claim 13, further comprising a feed portion configured to feed the print medium, wherein the controller determines a first pattern as a control pattern of the feed portion for printing a print line for which the first control mode is determined as the control mode, and determines a second pattern having a print period that is longer than the first pattern as the control pattern of the feed portion for printing a print line directly following the print line for which the first control mode is determined as the control mode.

18. The printer according to claim 13, wherein the controller determines a first voltage as a voltage to be applied to the heating elements for printing a print line for which the first control mode is determined as the control mode, and determines a second voltage being higher than the first voltage as a voltage to be applied to the heating elements for printing a print line directly following the print line for which the first control mode is determined as the control mode.

* * * * *